United States Patent [19]

Daitzman

[11] 4,138,120

[45] Feb. 6, 1979

[54] BOARD GAME

[76] Inventor: Reid Daitzman, 1425 Bedford St., Suite 1A, Stamford, Conn. 06905

[21] Appl. No.: 806,756

[22] Filed: Jun. 15, 1977

[51] Int. Cl.[2] ..... A63F 3/00

[52] U.S. Cl. ..... 273/271

[58] Field of Search ..... 273/130 R, 130 B, 130 C, 273/153 R, 271

[56] References Cited

U.S. PATENT DOCUMENTS

| | | | |
|---|---|---|---|
| 637,804 | 11/1899 | Kopetschny | 273/130 C UX |
| 854,547 | 5/1907 | Werner | 273/153 R UX |
| 1,550,552 | 8/1925 | McMahon | 273/153 R UX |
| 2,791,430 | 5/1957 | King | 273/130 R |
| 3,747,926 | 7/1973 | Odom | 273/130 B |

*Primary Examiner*—Anton O. Oechsle

*Attorney, Agent, or Firm*—Duffield & Lehrer

[57] ABSTRACT

Sixteen playing pieces are placed one at a time by two players on a game board comprised of sixteen squares arranged in four rows and four columns. The sixteen playing pieces are comprised of four sets of four pieces in each set. Two concepts, such as shape and color are involved and each playing piece is designed to exhibit two physical characteristics relating to such concepts. The four playing pieces of the first set may be round and white; those of the second set may be round and black; the third set may be square and white and the fourth set may be square and black. Two of the physical characteristics such as round and white or square and black are designated to each player. Points are scored for three or four like characteristics in series.

2 Claims, 3 Drawing Figures

BOARD GAME

BACKGROUND OF THE INVENTION

The present invention is directed toward a board game and more particularly toward a board game of the tic-tac-toe type but which utilizes a plurality of concepts.

Tic-tac-toe and similar games using the principles thereof have been known for many years. The idea of such games is to attempt to place a plurality of playing pieces or marks in a row while one's opponent attempts to do the same thing while simultaneously attempting to block the first player's attempt. Such games, however, have heretofore been played using only one concept at a time such as shapes or colors. For example, the conventional tic-tac-toe game is played on a board having nine squares arranged in three rows and three columns. The idea of the game is to attempt to get three X's or three O's in a row. The concept involved is thus shape: X's and O's.

When only one concept such as shape or color is involved, the game is less challenging and in fact may become monotonously simple. Numerous games have, of course, been devised which are substantially more complex and, therefore, more challenging. However, such games are normally difficult to learn and play and, therefore, cannot be played by small children. In addition, games which have been devised which may be played by children are generally not much of a challenge to adults.

SUMMARY OF THE INVENTION

The present invention, on the other hand, provides a board game which is easily learned and played by both youngsters and adults but which is also challenging to both groups. With the present invention, sixteen playing pieces are placed, one at a time by two players, on a game board comprised of sixteen squares arranged in four rows and four columns. The sixteen playing pieces are comprised of four sets of four pieces in each set. Two concepts, such as shape and color are involved and each playing piece is designed to exhibit two physical characteristics relating to such concepts. The four playing pieces of the first set may be round and white; those of the second set may be round and black; the third set may be square and white and the fourth set may be square and black. Two of the physical characteristics such as round and white or square and black are designated to each player. Points are scored for three or four like characteristics in series.

BRIEF DESCRIPTION OF THE DRAWINGS

For the purpose of illustrating the invention, there is shown in the accompanying drawing one form which is presently preferred; it being understood that the invention is not intended to be limited to the precise arrangements and instrumentalities shown.

DETAILED DESCRIPTION OF THE PREFERRED EMBODIMENT

Figure 1:
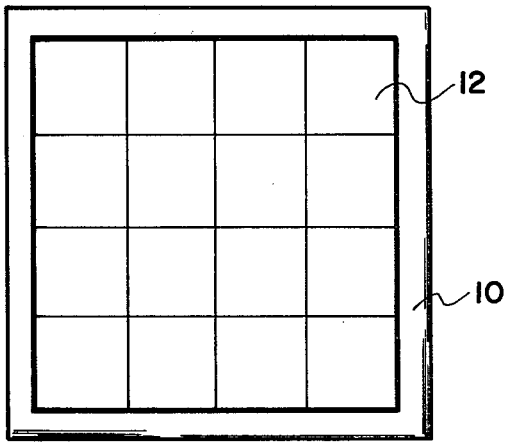
FIG. 1 is a top plan view of a game board utilized with the present invention.

Referring now to the drawing in detail wherein like numerals are used to designate like elements throughout the various figures thereof, there is shown in FIG. 1 a game board 10 employed with the present invention. The board 10 is preferably made of a relatively thin square sheet of hardboard, pressboard, cardboard or similar material. The upper surface of the board is divided into a plurality of substantially equal squares such as squares 12 arranged in a regular rectangular array. Preferably, the board 10 is divided into 16 such squares comprised of four rows and four columns.

Figure 2:
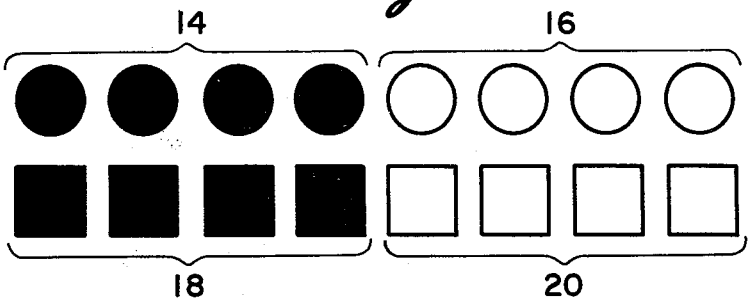
FIG. 2 is a top plan view of the playing pieces utilized with the present invention.

The playing pieces to be used with the board 10 are shown in FIG. 2. There are preferably sixteen playing pieces, one for each square 12 of the board 10. These are divided into four sets with four substantially identical playing pieces in each set. There are, for example, four black circular pieces 14, four white circular pieces 16, four black square pieces 18 and four white square pieces 20. The playing pieces 14, 16, 18 and 20 are small enough to fit within the squares 12 of the board 10 and have sufficient thickness so that the pieces can be easily placed on the board and picked up therefrom by hand.

As will become apparent hereinafter, the choice of colors such as black and white and of shapes such as circular and square are by way of example only. Numerous other possibilities exist. In order to practice the invention, any playing pieces satisfying the following criteria could be used. The requirements are that there be at least four sets of preferably four playing pieces and that each playing piece within each set be substantially identical to the other pieces within the same set. In addition, each playing piece must have two different recognizable physical characteristics. Preferably, the two different physical characteristics are of two different concepts. For example, with the playing pieces shown in FIG. 2, the two concepts are color and shape. The two physical characteristics of the playing pieces 14 are black and round; the two physical characteristics of the pieces 16 are white and round; the two physical characteristics of the pieces 18 are black and square and the two physical characteristics of the pieces 20 are white and square.

An additional requirement of the playing pieces is that the first physical characteristic of each piece in a set be the same as one of the physical characteristics of the pieces of a second set; the second physical characteristic of each piece in the first set being the same as one of the physical characteristics of each piece in the third set and that neither of the two physical characteristics of the playing pieces of the first set be the same as the playing pieces of the fourth set. For example, in the playing pieces shown in FIG. 2, playing pieces 14 share the characteristic black with the pieces 18 and they share the characteristic round with the playing pieces 16. However, neither of the two characteristics, i.e. round or black, is shared with the pieces 20.

By way of example, and not limitation, additional concepts which may be employed for the playing pieces are characters such as letters or numbers, size such as large and small or texture such as rough and smooth. For example, the four sets of playing pieces could be large X's, small X's, large O's and small O's. The concepts are, of course, letters i.e. X's and O's and size i.e. large and small. Numerous other combinations are, of course, possible.

The board game of the present invention utilizing the equipment above described is preferably played by two players. The playing pieces are first equally divided between the two players so that each player has two playing pieces 14, two playing pieces 16, two playing pieces 18 and two playing pieces 20 for a total of eight pieces. Before play is begun, each player is assigned two of the physical characteristics of the playing pieces, one from each concept. For example, the first player may be assigned white-circle and the second player may be assigned black-square.

The game is begun by the first player placing one of his eight pieces on one of the squares 12 anywhere on the board 10. The second player then places any one of his pieces which he desires on any of the unoccupied squares 12 of the board 10. Play continues in a like manner alternating between the first and second players until all of the playing pieces have been placed on the board and all of the squares 12 are occupied. The object of the game is to have either one or both of the player's designated characteristics appear three or four in series, either horizontally, vertically or diagonally (similar to tic-tac-toe). Seven points may be awarded for four in series and three points for three. Obviously, as the game is played, each player attempts to prevent the other player's designated characteristics from appearing three or four in series. If desired, a barrier in the form of a holder or the like may be provided for each player to prevent the other player from seeing the remaining pieces.

Figure 3:
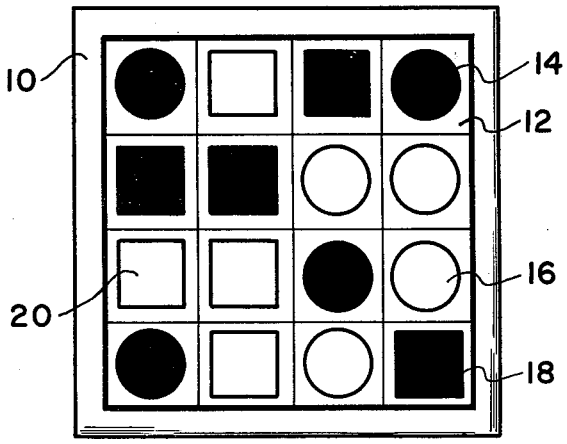
FIG. 3 is a top plan view of the game board and playing pieces upon the completion of a game.

FIG. 3 illustrates a completed game. It can be seen that the first player whose designated characteristics were white and circular has scored nine points: three points for the three consecutive circular pieces running vertically in the third and fourth columns and three points for the three consecutive white pieces running diagonally from the top of the second column to the penultimate box of the fourth column. The second player whose designated characteristics were black and square has scored seventeen points: seven points for the four squares running vertically in the second column, seven points for the four black pieces running diagonally from the top of the first column to the bottom of the last column and three points for the three squares running diagonally from the top of the third column to the penultimate box of the first column. Thus, the second player has won this game by a score of seventeen to nine. Games may, of course, be played individually or in sets or the winner may be the first person to score 100 points.

The present invention may be embodied in other specific forms without departing from the spirit or essential attributes thereof and, accordingly, reference should be made to the appended claims, rather than to the foregoing specification as indicating the scope of the invention.

I claim:

1. A board game comprising: a game board, said board being divided into an even number of spaces arranged in a regular rectangular array; a plurality of playing pieces, the number of playing pieces being equal to the number of spaces, said playing pieces being divided into four sets, the playing pieces within each set being substantially identical to each other and the number of playing pieces in each set being equal to the number of playing pieces in each of the other sets; the playing pieces of the first and second sets being of the same color but of different shape; the playing pieces of the first and third sets being of the same shape but of different color; the playing pieces of the second and fourth sets being of the same shape but of different color, and the playing pieces of the third and fourth sets being of the same color but of different shape.

2. A board game as claimed in claim 1 wherein said board is divided into sixteen spaces arranged in four rows and four columns.

* * * * *